US007099615B2

(12) United States Patent
Izumi

(10) Patent No.: US 7,099,615 B2
(45) Date of Patent: Aug. 29, 2006

(54) IMAGE FORMING APPARATUS WITH GUIDE MEMBER GUIDING IMAGE FORMING MEDIUM

(75) Inventor: Takao Izumi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 165 days.

(21) Appl. No.: 10/868,974

(22) Filed: Jun. 17, 2004

(65) Prior Publication Data

US 2004/0258439 A1 Dec. 23, 2004

(30) Foreign Application Priority Data

Jun. 20, 2003 (JP) ..... 2003-176825

(51) Int. Cl.
*G03G 15/16* (2006.01)

(52) U.S. Cl. ..... 399/316; 399/308; 399/388

(58) Field of Classification Search ..... 399/316, 399/317, 388, 390
See application file for complete search history.

(56) References Cited

U.S. PATENT DOCUMENTS 4,110,027 A * 8/1978 Sato et al. ..... 399/317
4,544,262 A * 10/1985 Kanemitsu et al. ..... 399/316
5,424,818 A * 6/1995 Yoshimura et al. ..... 399/316 X
5,453,823 A * 9/1995 Hashizume et al. ..... 399/316
6,493,534 B1 * 12/2002 Sawanaka et al. ..... 399/316
6,512,904 B1 * 1/2003 Sato et al. ..... 399/316 X
6,516,179 B1 * 2/2003 Sawai et al. ..... 399/388
2004/0253025 A1 * 12/2004 Matsuura ..... 399/316

FOREIGN PATENT DOCUMENTS

JP 2-176779 A 7/1990
JP 06-214470 A * 8/1994
JP 10-177307 A * 6/1998

* cited by examiner

*Primary Examiner*—Sophia S. Chen
(74) *Attorney, Agent, or Firm*—Foley & Lardner LLP

(57) ABSTRACT

An image forming apparatus is capable of preventing toner on an intermediate transfer medium from being scattered toward a sheet and hence capable of effecting printing with favorable image quality that is free from noise and contamination. A sheet transported from a regist roller is guided toward a transfer belt serving as an intermediate transfer medium along a guide member and then guided to the transfer nip between the transfer belt and a secondary transfer roller via the upper end edge of the guide member. The sheet already comes into close contact with the transfer belt at a position upstream of the transfer nip. Consequently, even if an electric field for transfer emitted from the secondary transfer roller extends as far as the periphery of the transfer nip, no part of toner on the transfer belt will be scattered toward the sheet.

10 Claims, 4 Drawing Sheets

IMAGE FORMING APPARATUS WITH GUIDE MEMBER GUIDING IMAGE FORMING MEDIUM

BACKGROUND OF THE INVENTION

1. Field of the Invention

The present invention relates to an image forming apparatus wherein a toner image formed on an image carrier is transferred to a sheet through an intermediate transfer medium.

2. Description of the Related Art

Image forming apparatus capable of printing color images electrophotographically, e.g. color printers, have become widespread.

In this type of color printer, the surface of a photosensitive drum serving as an image carrier is scanned with a laser beam, whereby an electrostatic latent image is formed on the surface of the photosensitive drum. The electrostatic latent image is sequentially developed with a yellow toner (developer), a magenta toner, a cyan toner, and a black toner. Each time development with toner of one color is completed, a developer image, i.e. a toner image, on the photosensitive drum is transferred (primarily transferred) to a transfer belt serving as an intermediate transfer medium. In this way, a full-color toner image is superimposedly transferred to the transfer belt.

When a black and white image is to be printed, an electrostatic latent image formed on the surface of the photosensitive drum is developed with only the black toner. After the development, the black toner image on the photosensitive drum is transferred (primarily transferred) to the transfer belt.

After the full-color toner image or the black toner image has been transferred to the transfer belt, a single sheet serving as an image forming medium is fed to the transfer nip between the transfer belt and a secondary transfer roller. At this time, a bias voltage for transfer is applied to the secondary transfer roller. The application of the bias voltage produces an electric field for transfer extending over from the secondary transfer roller to the transfer belt. The electric field allows the full-color or black toner image on the transfer belt to be secondarily transferred to the sheet.

A sheet that is to be transported to the transfer nip is fed from a sheet cassette by a feed roller through a regist roller serving as a transport roller. In this type of image forming apparatus, the regist roller is generally provided at a position closer to the frame of the apparatus than the transfer nip with a view to making the apparatus compact in size. The secondary transfer roller, which forms the transfer nip, is also provided closer to the frame of the image forming apparatus than the transfer belt.

Meanwhile, the transfer electric field emitted from the secondary transfer roller extends as far as the periphery of the transfer nip. Therefore, some problems have been experienced with the conventional image forming apparatus having the above-described positional relationship between the transfer nip and the regist roller. That is, when fed into the transfer nip, the sheet is transported thereto from a position closer to the secondary transfer roller than the transfer belt. Therefore, a part of toner on the transfer belt may be scattered toward the sheet to adhere to the surface of the sheet before it reaches the transfer nip. The undesired adhesion of toner causes noise and contamination, resulting in degradation of the image quality of the finished print.

SUMMARY OF THE INVENTION

An object of one aspect of this invention is to provide an image forming apparatus capable of preventing toner on the intermediate transfer medium from being scattered toward the image forming medium and hence capable of effecting printing with favorable image quality that is free from noise and contamination.

To solve the above-described problem, one aspect of the present invention provides an image forming apparatus including an image carrier on which a latent image is formed. A developing section that develops the latent image formed on the image carrier with a developer. The image forming apparatus further includes an intermediate transfer medium to which a developer image developed by the developing section is transferred. A transfer member cooperates with the intermediate transfer medium to form a transfer nip. The transfer member emits an electric field for transfer across the transfer nip through an image forming medium that is put in the transfer nip, thereby transferring the developer image transferred to the intermediate transfer medium to the image forming medium. A transport roller is provided closer to a frame of the image forming apparatus than the transfer nip to transport the image forming medium to the transfer nip. Further, the image forming apparatus includes at least one guide member that guides the image forming medium as transported from the transport roller to the transfer nip so that the image forming medium reaches the transfer nip after it has been brought closer to the intermediate transfer medium than an imaginary straight line connecting the transport roller and the transfer nip.

The above and other objects, features and advantages of the present invention will become more apparent from the following description of the preferred embodiments thereof, taken in conjunction with the accompanying drawings.

DESCRIPTION OF THE PREFERRED EMBODIMENTS

Embodiments of the present invention will be described below with reference to the accompanying drawings.

FIRST EMBODIMENT

Figure 1:
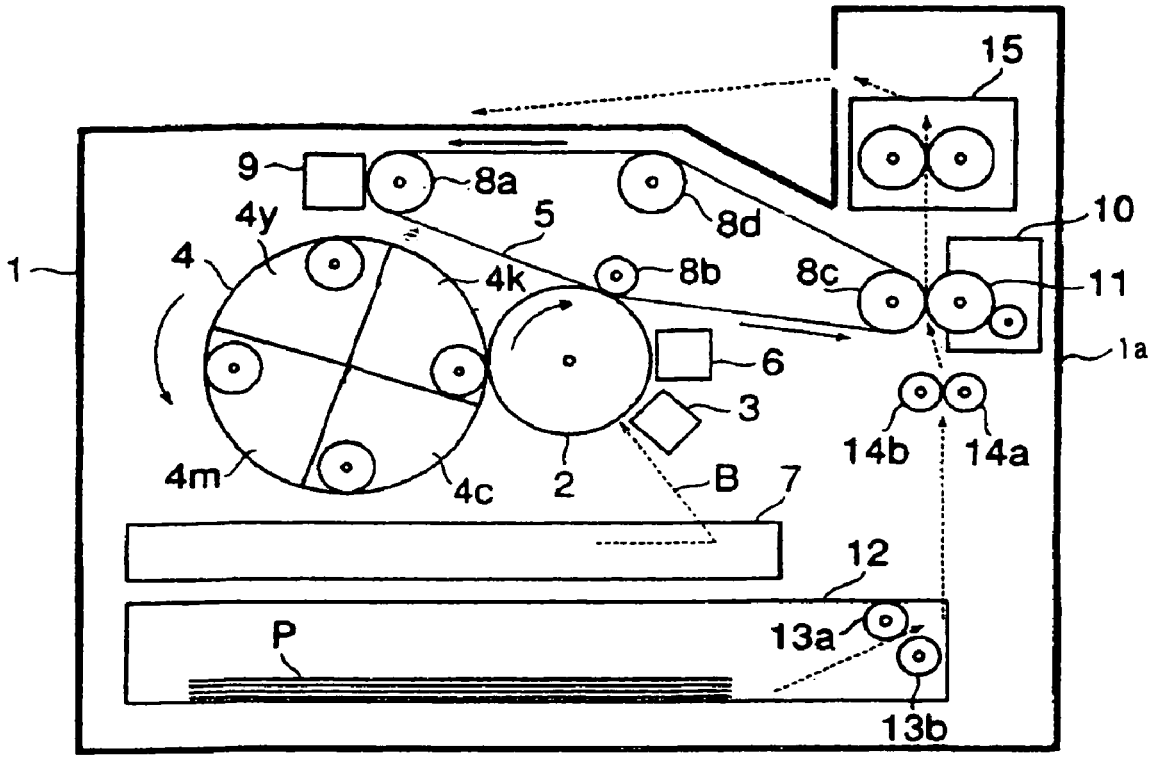
FIG. 1 is a schematic sectional view showing the internal arrangement of each embodiment of the present invention.

FIG. 1 shows the arrangement of a color image forming apparatus, i.e. a color printer, using an electrophotographic process. The color printer has a body 1 with a frame 1*a*. A photosensitive drum 2 serving as an image carrier is provided approximately in the center of the frame 1*a*. A charging unit 3, a color developing unit 4, a transfer belt 5 as an intermediate transfer medium, and a destaticizer/cleaner 6 are positioned around the photosensitive drum 2.

The charging unit 3 applies a high-level bias voltage to the photosensitive drum 2, thereby electrostatically charging the surface of the photosensitive drum 2. The charged surface of the photosensitive drum 2 is irradiated with a laser beam B from an optical system unit 7. The laser beam B scans the surface of the photosensitive drum 2 in one direction to effect horizontal scanning (line scanning). The horizontal scanning is repeated as the photosensitive drum 2 rotates, thereby effecting vertical scanning. In this way, an electrostatic latent image is formed on the surface of the photosensitive drum 2 on the basis of an image signal input from the outside.

The color developing unit 4 is of the revolver type that is rotatable in the direction indicated by the arrow in the figure. The color developing unit 4 has a yellow developing section 4*y*, a magenta developing section 4*m*, a cyan developing section 4*c*, and a black developing section 4*k*. The yellow developing section 4*y* has yellow toner for printing a yellow image and supplies the yellow toner to the surface of the photosensitive drum 2 through a developing roller. The magenta developing section 4*m* has magenta toner for printing a magenta image and supplies the magenta toner to the surface of the photosensitive drum 2 through a developing roller.

The cyan developing section 4*c* has a cyan toner for printing a cyan image and supplies the cyan toner to the surface of the photosensitive drum 2 through a developing roller. The black developing section 4*k* has black toner for printing a black image and supplies the black toner to the surface of the photosensitive drum 2 through a developing roller. When printing is not performed, the black developing section 4*k* stands by at a position where it faces opposite the photosensitive drum 2.

Color printing is performed as follows. An electrostatic latent image corresponding to a color image is formed on the surface of the photosensitive drum 2. The electrostatic latent image is developed by the black developing section 4*k*. The developed black toner image is transferred from the photosensitive drum 2 to the transfer belt 5. Next, the color developing unit 4 rotates, and the cyan developing section 4*c* faces opposite the photosensitive drum 2. In this state, an electrostatic latent image corresponding to a cyan image is formed on the surface of the photosensitive drum 2. The electrostatic latent image is developed by the cyan developing section 4*c*. The developed cyan toner image is transferred from the photosensitive drum 2 to the transfer belt 5.

Subsequently, the color developing unit 4 rotates, and the magenta developing section 4*m* faces opposite the photosensitive drum 2. In this state, an electrostatic latent image corresponding to a magenta image is formed on the surface of the photosensitive drum 2. The electrostatic latent image is developed by the magenta developing section 4*m*. The developed magenta toner image is transferred from the photosensitive drum 2 to the transfer belt 5.

Further, the color developing unit 4 rotates, and the yellow developing section 4*y* faces opposite the photosensitive drum 2. In this state, an electrostatic latent image corresponding to a yellow image is formed on the surface of the photosensitive drum 2. The electrostatic latent image is developed by the yellow developing section 4*y*. The developed yellow image is transferred from the photosensitive drum 2 to the transfer belt 5. In this way, a full-color toner image consisting of superimposed toner images is formed on the transfer belt 5.

In black and white printing, an electrostatic latent image corresponding to a black and white image is formed on the surface of the photosensitive drum 2, and the electrostatic latent image is developed by the black developing section 4*k*. The developed black toner image is transferred from the photosensitive drum 2 to the transfer belt 5. In this way, a toner image made of only the black toner is formed on the transfer belt 5.

Toner and charge remain on the photosensitive drum 2 after the primary transfer. The remaining toner and charge are removed by the destaticizer/cleaner 6.

The transfer belt 5 is annularly stretched in such a manner as to pass around a driving roller 8*a*, a primary transfer roller 8*b*, a secondary transfer backup roller 8*c*, and a tension roller 8*d*. The transfer belt 5 rotates in the direction indicated by the arrows in the figure to move between the photosensitive drum 2 and a secondary transfer roller 11 in a secondary transfer unit 10. The secondary transfer backup roller 8*c* is made of aluminum and electrically grounded. Toner remaining on the transfer belt 5 is removed by a cleaner 9.

The secondary transfer unit 10 causes the secondary transfer roller 11 to abut against the transfer belt 5 in synchronization with the arrival of the toner image on the transfer belt 5 at a position corresponding to the secondary transfer roller 11. After the abutment has been made, a bias voltage Vb for transfer is applied to the secondary transfer roller 11 in timed relation to the feed of a sheet P (described later) into the transfer nip between the secondary transfer roller 11 and the transfer belt 5. The application of the bias voltage Vb produces an electric field for transfer between the secondary transfer roller 11 and the transfer belt 5.

The electric field allows the toner image on the transfer belt 5 to be secondarily transferred to the sheet P. Further, the secondary transfer unit 10 turns off the application of the bias voltage Vb after the sheet P has come out of the transfer nip. Thereafter, the secondary transfer unit 10 causes the secondary transfer roller 11 to separate from the transfer belt 5.

The sheet P subjected to the secondary transfer and fed out from the transfer nip is sent to a fixing unit 15. The fixing unit 15 fixes the toner image on the sheet P by heat and pressure. The sheet P passed through the fixing unit 15 is discharged onto the top of the body 1.

Meanwhile, a sheet cassette 12 is provided in the bottom of the body 1. The sheet cassette 12 contains an image forming medium, e.g. a large number of sheets P. The sheet cassette 12 is provided with a feed roller 13*a* and an opposed roller 13*b* for taking out the sheets P one by one. A sheet P taken out from the sheet cassette 12 is transported to a combination of a regist roller 14*a* and an opposed roller 14*b* along the path shown by the broken line in the figure.

The regist roller 14*a* transports the sheet P taken out from the sheet cassette 12 to the transfer nip between the transfer belt 5 and the secondary transfer roller 11 at an optimal timing synchronized with the rotation of the transfer belt 5. In the above-described arrangement, the secondary transfer roller 11 and the regist roller 14*a* are provided closer to the side wall of the frame 1*a* than the transfer nip with a view to making the image forming apparatus compact in size.

Figure 2:
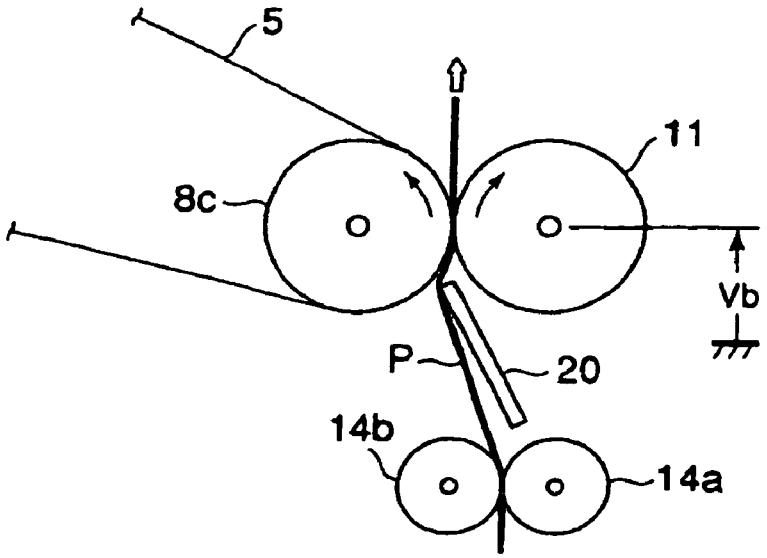
FIG. 2 is a diagram showing the arrangement of an essential part of a first embodiment of the present invention.

Further, as shown in FIG. 2, a guide member 20 is provided to extend over from the position of the regist roller 14*a* toward the transfer nip. The guide member 20 is a single plate-shaped member provided to extend slantingly from the neighborhood of the regist roller 14*a* to the neighborhood of the transfer belt 5. The guide member 20 has a configuration extending in the axial direction of the secondary transfer roller 11. The guide member 20 guides the sheet P as transported from the regist roller 14*a* to the transfer nip so that the sheet P reaches the transfer nip after it has been brought closer to the transfer belt 5 than an imaginary straight line connecting the regist roller 14*a* and the transfer nip.

Figure 3:
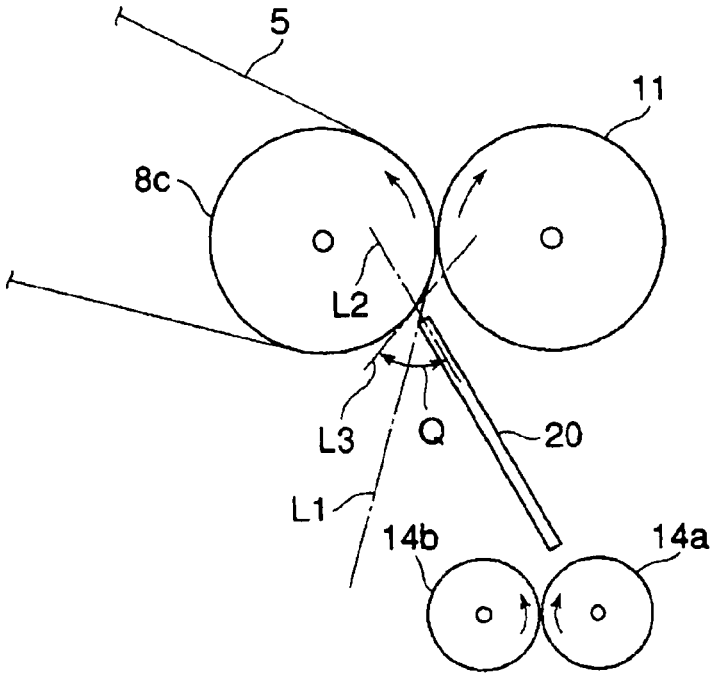
FIG. 3 is a diagram showing the positional relationship between constituent elements in FIG. 2.

The installation conditions of the guide member 20 are shown in FIG. 3. That is, the upper end edge of the guide member 20 (i.e. an end edge of the guide member 20 that is closer to the transfer belt 5) lies on a tangent line L1 at a point on the outer peripheral surface of the transfer belt 5 (i.e. the curved surface of the transfer belt 5 along the secondary transfer backup roller 8*c*) that is, for example, at least 2 millimeters upstream of the transfer nip. In addition, the upper end edge of the guide member 20 is at least 2 millimeters away from the outer peripheral surface of the transfer belt 5. Further, the angle Q between an extension line L2 extending along the plate surface of the guide member 20 toward the transfer belt 5 and a tangent line L3 at a point on the outer peripheral surface of the transfer belt 5 at which the extension line L2 touches the outer peripheral surface of the transfer belt 5 is set less than 90 degrees, e.g. at 85 degrees.

The operation of the image forming apparatus having the above-described arrangement will be described below.

The surface of the photosensitive drum 2 is scanned with a laser beam B, whereby an electrostatic latent image is formed on the surface of the photosensitive drum 2. The electrostatic latent image is developed sequentially with toners of four colors supplied from the color developing unit 4. Each time the development with one color is completed, the toner image on the photosensitive drum 2 is primarily transferred to the transfer belt 5. In this way, a full-color toner image is superimposedly transferred to the transfer belt 5.

In the case of black and white printing, an electrostatic latent image formed on the surface of the photosensitive drum 2 is developed with only black toner supplied from the color developing unit 4. After the development, the toner image on the photosensitive drum 2 is primarily transferred to the transfer belt 5.

After the full-color toner image or the black toner image has been transferred to the transfer belt 5, a single sheet P is transported from the regist roller 14*a* toward the transfer nip between the transfer belt 5 and the secondary transfer roller 11. At this time, a bias voltage Vb for transfer is applied to the secondary transfer roller 11. The application of the bias voltage Vb produces an electric field for transfer extending over from the secondary transfer roller 11 to the transfer belt 5. The electric field allows the toner image on the transfer belt 5 to be secondarily transferred to the sheet P.

In this case, the sheet P transported from the regist roller 14*a* is guided toward the transfer belt 5 along the guide member 20 and then guided to the transfer nip along the above-described tangent line L1 after passing over the upper end edge of the guide member 20. Accordingly, the sheet P already comes into close contact with the transfer belt 5 at a position upstream of the transfer nip.

With the above-described arrangement, the sheet P comes into close contact with the transfer belt 5 upstream of the transfer nip. Therefore, even if the transfer electric field emitted from the secondary transfer roller 11 extends as far as the periphery of the transfer nip, no part of toner on the transfer belt 5 will be scattered toward the sheet P. Accordingly, there is no likelihood of undesired adhesion of toner to the surface of the sheet P before it reaches the transfer nip. As a result, it becomes possible to effect printing with favorable image quality that is free from noise and contamination.

In the case of color printing, toner images of four colors are sequentially deposited on the transfer belt 5 while being superimposed on one another with an increased toner thickness. For each deposit of toner images, the transfer belt 5 passes the neighborhood of the upper end edge of the guide member 20. In this case, even when the transfer belt 5 having a large amount of toner with an increased thickness passes the neighborhood of the upper end edge of the guide member 20, because a clearance of at least 2 millimeters is ensured between the transfer belt 5 and the upper end edge of the guide member 20, there is no likelihood of toner on the transfer belt 5 adhering to the upper end edge of the guide member 20 or to the sheet P fed via the upper end edge of the guide member 20. In this regard also, it becomes possible to effect printing with favorable image quality that is free from noise and contamination.

Moreover, the angle Q between an extension line L2 extending along the plate surface of the guide member 20 toward the transfer belt 5 and a tangent line L3 at a point on the outer peripheral surface of the transfer belt 5 at which the extension line L2 touches the outer peripheral surface of the transfer belt 5 is set less than 90 degrees, e.g. at 85 degrees. Consequently, the sheet P is sufficiently curled along the upper end edge of the guide member 20 before coming into contact with the transfer belt 5. By virtue of the curling thereof, the sheet P can smoothly separate from the transfer belt 5 as it leaves the transfer nip. The sheet P separating from the transfer belt 5 can enter the fixing unit 15 smoothly.

SECOND EMBODIMENT

A second embodiment of the present invention will be described below.

Figure 4:
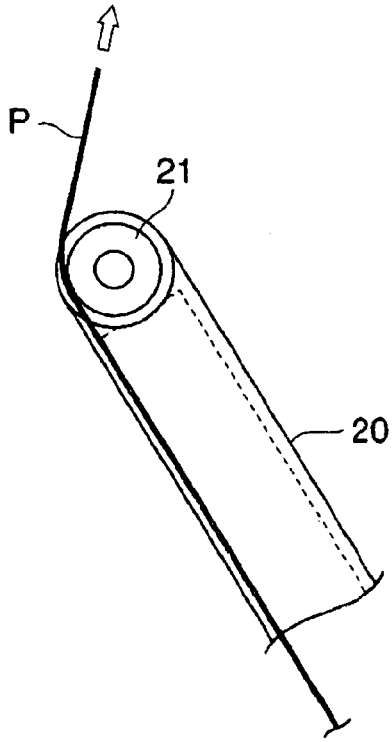
FIG. 4 is a diagram showing the arrangement of an essential part of a second embodiment of the present invention.

As shown in FIG. 4, a roller 21 is provided at the upper end of the guide member 20 (i.e. an end thereof closer to the transfer belt 5). The roller 21 rotates in response to the movement of the sheet P.

The roller 21 minimizes friction occurring between the upper end edge of the guide member 20 and the sheet P and allows the sheet P to move smoothly. It is also possible to avoid damage to the sheet P.

The rest of the arrangement of the second embodiment and the operation thereof are the same as in the first embodiment.

THIRD EMBODIMENT

A third embodiment of the present invention will be described below.

Figure 5:
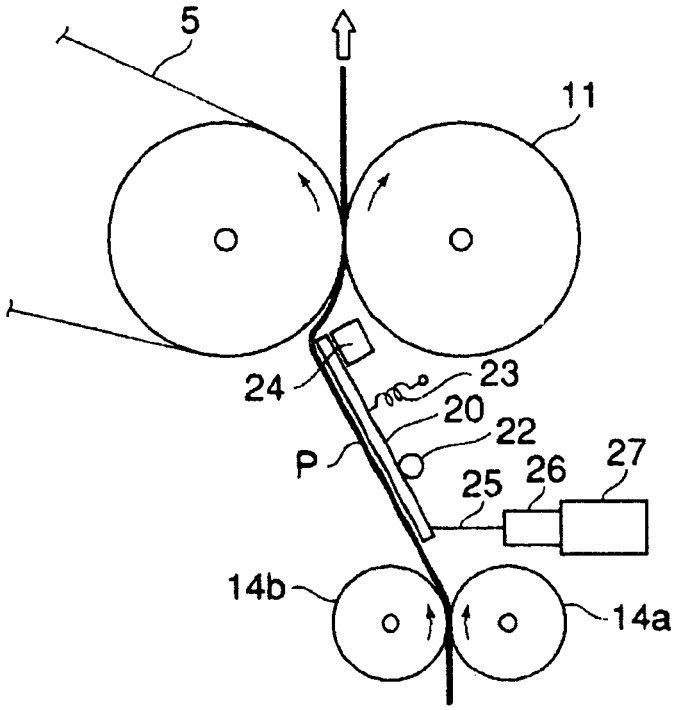
FIG. 5 is a diagram showing the arrangement of an essential part of a third embodiment of the present invention.
Figure 6:
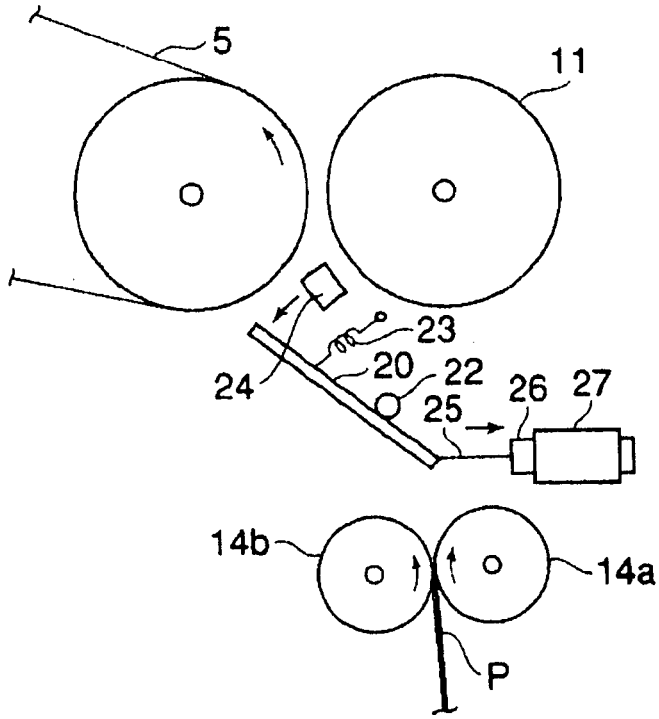
FIG. 6 is a diagram showing the movement of each constituent element in FIG. 5.

As shown in FIGS. 5 and 6, the guide member 20 is pivotably supported at an intermediate portion thereof by a support member 22. A spring 23 is connected to the guide member 20 at a position above the support member 22 (i.e. closer to the transfer belt 5). The spring 23 applies biasing force to the guide member 20 toward the secondary transfer roller 11.

A stopper 24 is provided in the neighborhood of the secondary transfer roller 11 to limit the movement of the guide member 20 by the biasing force of the spring 23. In a state where the upper end portion of the guide member 20 abuts on the stopper 24 as shown in FIG. 5, the guide member 20 is in the same position as the guide member 20 in the first embodiment.

The lower end portion of the guide member 20 (i.e. an end portion closer to the regist roller 14*a*) is connected to a plunger 26 through a rod 25. The rod 25 and the plunger 26, together with a solenoid 27, constitute a driving mechanism that causes the guide member 20 to pivot when no sheet P is transported from the regist roller 14*a*.

When the solenoid 27 is activated (energized), as shown in FIG. 6, the plunger 26 is withdrawn into the solenoid 27, and hence the rod 25 is retracted. This causes the upper end portion of the guide member 20 to separate from the stopper 24 against the biasing force of the spring 23. The position of the guide member 20 at this time is referred to as "retraction position".

The solenoid 27 is activated when the sheet P is standing by at the regist roller 14*a*. It should be noted that, at this time, the secondary transfer roller 11 is separate from the transfer belt 5. As the guide member 20 moves to the retraction position when the sheet P is standing by, the distance between the upper end edge of the guide member 20 and the transfer belt 5 increases. By virtue of the increased distance, even if a large amount of toner is present on the transfer belt 5, it is possible to prevent the toner from adhering to the upper end edge of the guide member 20.

A clearance of at least 2 millimeters has been ensured between the transfer belt 5 and the upper end edge of the guide member 20 from the beginning to prevent toner on the transfer belt 5 from adhering to the upper end edge of the guide member 20. In addition thereto, the guide member 20 moves to the retraction position. Consequently, undesired adhesion of toner to the guide member 20 can be prevented completely.

Immediately before the sheet P is fed into the transfer nip from the regist roller 14*a*, the solenoid 27 is deactivated to allow the guide member 20 to return to the steady-state position shown in FIG. 5.

The rest of the arrangement of the third embodiment and the operation thereof are the same as in the first embodiment.

FOURTH EMBODIMENT

A fourth embodiment of the present invention will be described below.

Figure 7:
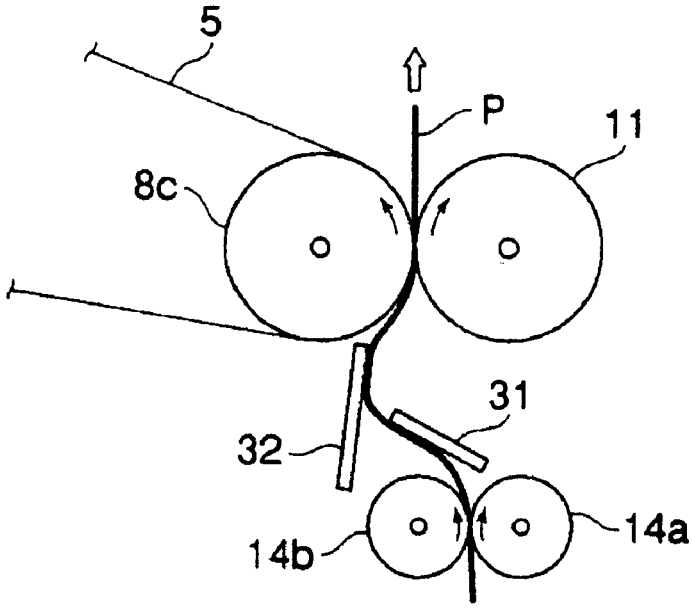
FIG. 7 is a diagram showing the arrangement of an essential part of a fourth embodiment of the present invention.

As shown in FIG. 7, a first plate-shaped member 31 is provided as a guide member for guiding a sheet P transported from the regist roller 14*a* toward the transfer belt 5. Further, a second plate-shaped member 32 is provided as a guide member for guiding the sheet P transported via the first plate-shaped member 31 to the transfer nip.

Figure 8:
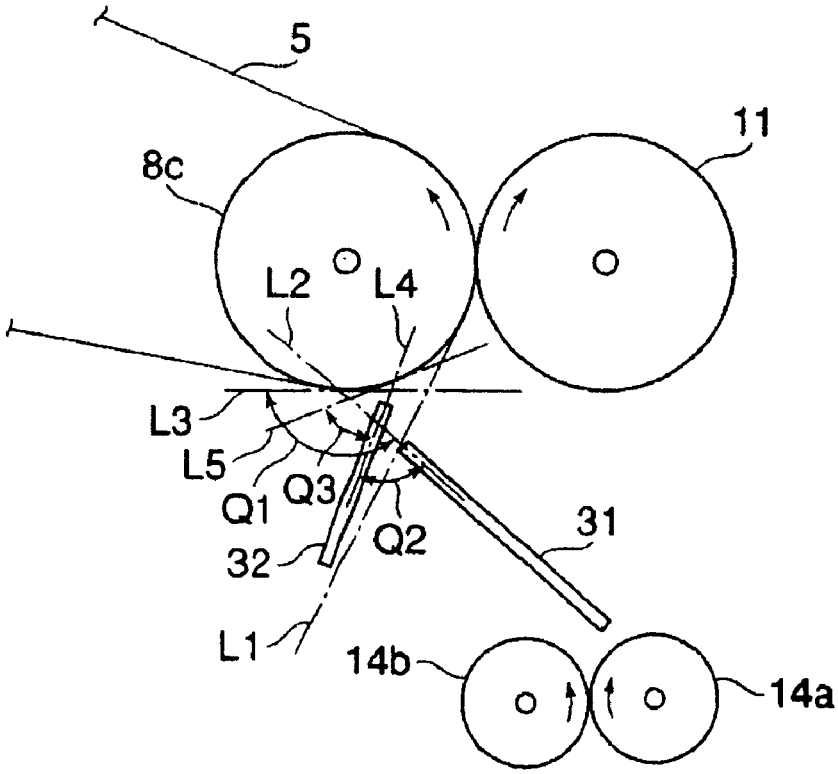
FIG. 8 is a diagram showing the positional relationship between constituent elements in FIG. 7.

The plate-shaped member 31 is provided to extend slantingly from the neighborhood of the regist roller 14*a* to the neighborhood of the plate-shaped member 32. The plate-shaped member 31 has a configuration extending in the axial direction of the secondary transfer roller 11. As shown in FIG. 8, an end edge of the plate-shaped member 31 closer to the plate-shaped member 32 lies on a tangent line L1 at a point on the outer peripheral surface of the transfer belt 5 (i.e. the curved surface of the transfer belt 5 along the secondary transfer backup roller 8*c*) that is, for example, at least 2 millimeters upstream of the transfer nip.

Further, as shown in FIG. 8, the angle Q1 between an extension line L2 extending along the plate surface of the plate-shaped member 31 toward the transfer belt 5 and a tangent line L3 at a point on the outer peripheral surface of the transfer belt 5 at which the extension line L2 touches the outer peripheral surface of the transfer belt 5 is set not less than 90 degrees. The plate-shaped member 32 is provided slantingly to cross the extension line L2. An end edge of the plate-shaped member 32 closer to the transfer belt 5 is at least 2 millimeters away from the transfer belt 5.

The angle Q2 between an extension line L4 extending along the plate surface of the plate-shaped member 32 toward the transfer belt 5 and the extension line L2 is set less than 90 degrees. The angle Q3 between the extension line L4 and a tangent line L5 at a point on the outer peripheral surface of the transfer belt 5 at which the extension line L4 touches the outer peripheral surface of the transfer belt 5 is set less than 90 degrees.

The operation of the fourth embodiment will be described below.

A sheet P transported from the regist roller 14*a* is guided toward the transfer belt 5 along the plate-shaped member 31. After leaving the upper end edge of the plate-shaped member 31, the sheet P is guided to the transfer nip along the plate-shaped member 32. At this time, the sheet P already comes into close contact with the transfer belt 5 at a position upstream of the transfer nip.

With the above-described arrangement, the sheet P comes into close contact with the transfer belt 5 upstream of the transfer nip. Therefore, even if the transfer electric field emitted from the secondary transfer roller 11 extends as far as the periphery of the transfer nip, no part of toner on the transfer belt 5 will be scattered toward the sheet P. Accordingly, there is no likelihood of undesired adhesion of toner to the surface of the sheet P before it reaches the transfer nip. As a result, it becomes possible to effect printing with favorable image quality that is free from noise and contamination.

In the case of color printing, toner images of four colors are sequentially deposited on the transfer belt 5 while being superimposed on one another with an increased toner thickness. For each deposit of toner images, the transfer belt 5 passes the neighborhood of the upper end edge of the plate-shaped member 32. In this case, even when the transfer belt 5 having a large amount of toner with an increased thickness passes the neighborhood of the upper end edge of the plate-shaped member 32, because a clearance of at least 2 millimeters is ensured between the transfer belt 5 and the upper end edge of the plate-shaped member 32, there is no likelihood of toner on the transfer belt 5 adhering to the upper end edge of the plate-shaped member 32 or to the sheet P transported via the upper end edge of the plate-shaped member 32. In this regard also, it becomes possible to effect printing with favorable image quality that is free from noise and contamination.

Moreover, the angle Q2 between an extension line L4 extending along the plate surface of the plate-shaped member 32 toward the transfer belt 5 and an extension line L2 extending along the plate surface of the plate-shaped member 31 toward the transfer belt 5 is set less than 90 degrees. Consequently, the sheet P is sufficiently curled along the upper end edge of the plate-shaped member 31 and travels along the plate surface of the plate-shaped member 32 before coming into contact with the transfer belt 5. By virtue of the curling thereof, the sheet P can smoothly separate from the transfer belt 5 as it leaves the transfer nip. The sheet P separating from the transfer belt 5 can enter the fixing unit 15 smoothly.

A roller 21 may be provided at the upper end of the plate-shaped member 31 as in the case of the second embodiment. The roller 21 minimizes friction occurring between the upper end edge of the plate-shaped member 31 and the sheet P and allows the sheet P to move smoothly. It is also possible to avoid damage to the sheet P.

It should be noted that the present invention is not necessarily limited to the foregoing embodiments but may be embodied, when it is carried out, by modifying constituent elements thereof without departing from the gist of the present invention. For example, although a transfer roller is used in the foregoing embodiments, a transfer blade may be used in place of the transfer roller. Further, various inventions can be formed by properly combining together a plurality of constituent elements disclosed in the foregoing embodiments. For example, some constituent elements may be eliminated from those disclosed in each embodiment. Further, constituent elements in different embodiments may be combined together properly.

As has been detailed above, it is possible according to the present invention to prevent toner on the intermediate transfer medium from being scattered toward the image forming medium and hence possible to provide an image forming apparatus capable of effecting printing with favorable image quality that is free from noise and contamination.

What is claimed is:

1. An image forming apparatus comprising:

an image carrier on which a latent image is formed;

a developing section that develops the latent image formed on said image carrier with a developer;

an intermediate transfer medium to which a developer image developed by said developing section is transferred;

a transfer member that cooperates with said intermediate transfer medium to form a transfer nip and emits an electric field for transfer across said transfer nip through an image forming medium that is put in said transfer nip, thereby transferring the developer image transferred to said intermediate transfer medium to said image forming medium;

a transport roller provided closer to a frame of said image forming apparatus than said transfer nip to transport said image forming medium to said transfer nip; and at least one guide member that guides the image forming medium as transported from said transport roller to said transfer nip so that said image forming medium reaches said transfer nip after it has been brought closer to said intermediate transfer medium than an imaginary straight line connecting said transport roller and said transfer nip, wherein said intermediate transfer medium is an annular transfer belt, which rotationally moves between said image carrier and said transfer member, wherein said guide member is a single plate-shaped member provided to extend slantingly from a neighborhood of said transport roller to a neighborhood of said transfer belt.

wherein an end edge of said plate-shaped member that is closer to said transfer belt lies on a tangent line L1 at a point on an outer peripheral surface of said transfer belt that is upstream of said transfer nip, and said end edge of said plate-shaped member is at least 2 millimeters away from the outer peripheral surface of said transfer belt.

2. An image forming apparatus comprising:

an image carrier on which a latent image is formed;

a developing section that develops the latent image formed on said image carrier With a developer;

an intermediate transfer medium to which a developer image developed by said developing section is transferred;

a transfer member that cooperates with said intermediate transfer medium to form a transfer nip and emits an electric field for transfer across said transfer nip through an image forming medium that is put in said transfer nip, thereby transferring the developer image transferred to said intermediate transfer medium to said image forming medium;

a transport roller provided closer to a frame of said image forming apparatus than said transfer nip to transport said image forming medium to said transfer nip; and at least one guide member that guides the image forming medium as transported from said transport roller to said transfer nip so that said image forming medium reaches said transfer nip after it has been brought closer to said intermediate transfer medium than an imaginary straight line connecting said transport roller and said transfer nip, wherein said intermediate transfer medium is an annular transfer belt, which rotationally moves between said image carrier and said transfer member, wherein said guide member is a single plate-shaped member provided to extend slantingly from a neighborhood of said transport roller to a neighborhood of said transfer belt, wherein an angle Q between an extension line L2 extending along a plate surface of said plate-shaped member toward said transfer belt and a tangent line L3 at a point on an outer peripheral surface of said transfer belt at which said extension line L2 touches the outer peripheral surface of said transfer belt is less than 90 degrees.

3. An image forming apparatus according to claim 2, further comprising:

a roller provided at an end of said guide member closer to said intermediate transfer medium, said roller rotating in response to movement of said image forming medium.

4. An image forming apparatus according to claim 2, wherein said guide member is a plate-shaped member provided to extend slantingly from a neighborhood of said transport roller to a neighborhood of said transfer belt, said plate-shaped member being pivotable in a direction in which an end of said plate-shaped member closer to said transfer belt comes away from said transfer belt.

5. An image forming apparatus according to claim 4, further comprising:

a driving mechanism that causes said guide member to pivot when said image forming medium is not transported from said transport roller.

6. An image forming apparatus according to claim 2, wherein said image forming medium is transported from a cassette, from which it is supplied, to said transport roller approximately in a vertical direction.

7. An image forming apparatus comprising:

an image carrier on which a latent image is formed;

a developing section that develops the latent image formed on said image carrier with a developer;

an intermediate transfer medium to which a developer image developed by said developing section is transferred;

a transfer member that cooperates with said intermediate transfer medium to form a transfer nip and emits an electric field for transfer across said transfer nip through an image forming medium that is put in said transfer nip, thereby transferring the developer image transferred to said intermediate transfer medium to said image forming medium;

a transport roller provided closer to a frame of said image forming apparatus than said transfer nip to transport said image forming medium to said transfer nip; and p1 at least one guide member that guides the image forming medium as transported from said transport roller to said transfer nip so that said image forming medium reaches said transfer nip after it has been brought closer to said intermediate transfer medium than an imaginary straight line connecting said transport roller and said transfer nip, wherein said intermediate transfer medium is an annular transfer belt, which rotationally moves between said image carrier and said transfer member, wherein said guide member includes a first plate-shaped member that guides the image forming medium transported from said transport roller toward said transfer belt, and a second plate-shaped member that guides the image forming medium transported via said first plate-shaped member to said transfer nip, wherein said first plate-shaped member is provided to extend slantingly from a neighborhood of said transport roller to a neighborhood of said second plate-shaped member, wherein an end edge of said first plate-shaped member closer to said second plate-shaped member lies on a tangent line L1 at a point on an outer peripheral surface of said transfer belt that is upstream of said transfer nip, and an angle Q1 between an extension line L2 extending along a plate surface of said first plate-shaped member toward said transfer belt and a tangent line L3 at a point on the outer peripheral surface of said transfer belt at which said extension line L2 touches the outer peripheral surface of said transfer belt is not less than 90 degrees.

8. An image forming apparatus according to claim 7, wherein said second plate-shaped member is provided slantingly to cross said extension line L2, wherein an end edge of said second plate-shaped member closer to said transfer belt is at least 2 millimeters away from said transfer belt, and an angle Q2 between an extension line L4 extending along a plate surface of said second plate-shaped member toward said transfer belt and said extension line L2 is less than 90 degrees.

9. An image forming apparatus according to claim 8, wherein an angle Q3 between said extension line L4 and a tangent line L5 at a point on the outer peripheral surface of said transfer belt at which said extension line L4 touches the outer peripheral surface of said transfer belt is less than 90 degrees.

10. An image forming apparatus comprising:

an image carrier on which a latent image is formed;

a developing section that develops the latent image formed on said image carrier with a developer;

an intermediate transfer medium to which a developer image developed by said developing section is transferred;

a transfer member that cooperates with said intermediate transfer medium to form a transfer nip and emits an electric field for transfer across said transfer nip through an image forming medium that is put in said transfer nip, thereby transferring the developer image transferred to said intermediate transfer medium to said image forming medium;

a transport roller that transports said image forming medium to said transfer nip; and at least one guide member that guides the image forming medium as transported from said transport roller to said transfer nip so that said image forming medium reaches said transfer nip after it has been brought closer to said intermediate transfer medium than an imaginary straight line connecting said transport roller and said transfer nip, wherein said intermediate transfer medium is an annular transfer belt, which rotationally moves between said image carrier and said transfer member, wherein an angle Q between an extension line L2 extending along a surface of said guide member toward said transfer belt and a tangent line L3 at a point on an outer peripheral surface of said transfer belt at which said extension line L2 touches the outer peripheral surface of said transfer belt is less than 90 degrees, wherein said guide member guides the image forming medium on at least a portion of said surface of said guide member.

* * * * *